US005305293A

United States Patent [19]

Eliachar et al.

[11] Patent Number: 5,305,293

[45] Date of Patent: Apr. 19, 1994

[54] WATCH

[76] Inventors: Eliahu Eliachar, 25 Yafe Nof Street, 34 371 Haifa; Rakefet Walter, 24 Harel Street, 34 555 Haifa; Dan Ashkenazi, 3 Eshkolot Street, 34 321 Haifa, all of Israel

[21] Appl. No.: 974,437

[22] Filed: Nov. 12, 1992

[30] Foreign Application Priority Data

Nov. 15, 1991 [IL] Israel ..... 100060

[51] Int. Cl.[5] ..... G04B 19/20

[52] U.S. Cl. ..... 368/282; 368/281

[58] Field of Search ..... 368/281, 282

[56] References Cited

U.S. PATENT DOCUMENTS 4,130,987 12/1978 Schickedanz ..... 368/282

4,473,304 9/1984 Ketner ..... 368/281

4,525,077 6/1985 Ketner ..... 368/281

4,627,739 12/1986 Shingo et al. ..... 368/282

*Primary Examiner*—Bernard Roskoski

*Attorney, Agent, or Firm*—Benjamin J. Barish

[57] ABSTRACT

A watch includes an annular member, such as a bracelet, viewable graduation markings around its circumference graduated according to time; a pointer member on the circumference of the annular member and viewable with the graduation markings; and a drive for effecting relative movement between the pointer and the graduation markings at a predetermined uniform velocity such that the pointer indicates the time according to its location relative to the graduation markings on the circumference of the annular member.

20 Claims, 1 Drawing Sheet

FIG . 1
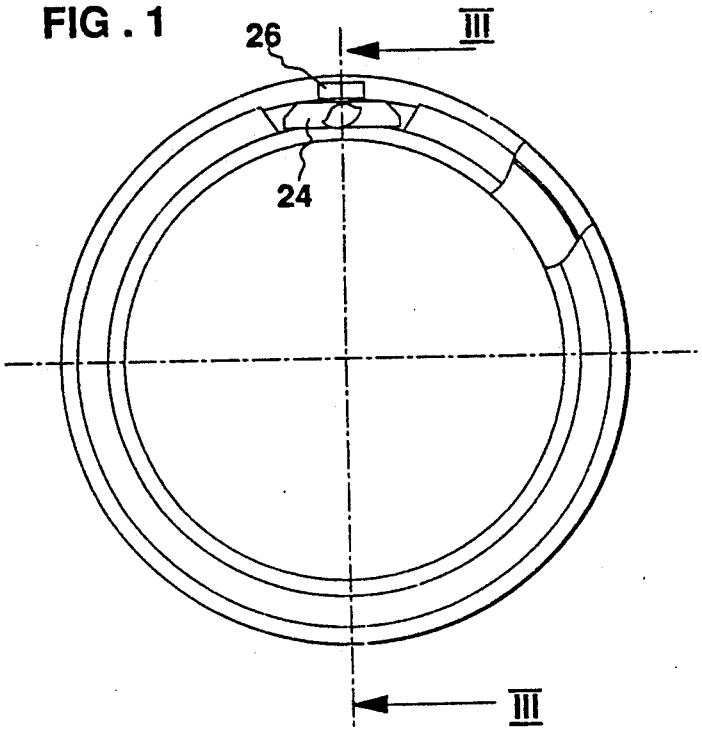
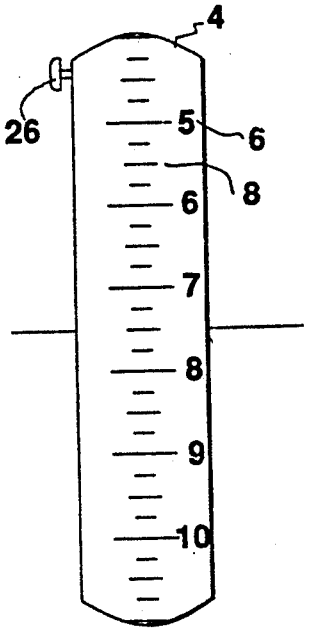
FIG . 2
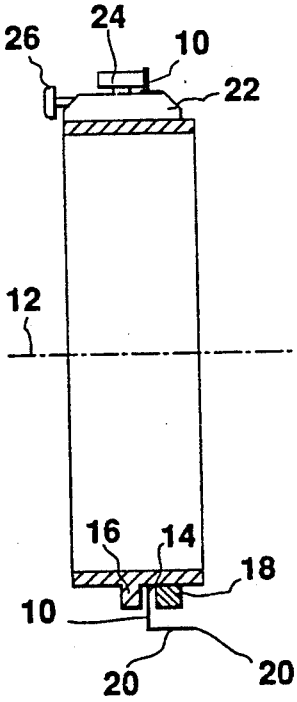
FIG . 3
FIG . 4
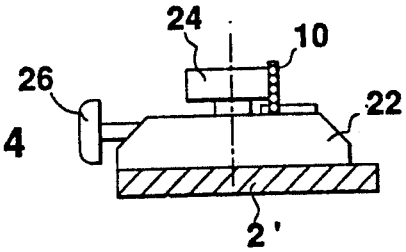
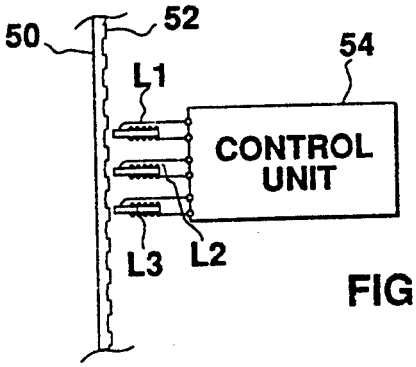
FIG . 5

WATCH

FIELD AND BACKGROUND OF THE INVENTION

The present invention relates to watches, and particularly to a wrist watch which may also serve as an ornamental bracelet.

Many bracelet type wrist watches have been proposed in the patent literature, some examples of which are shown in U.S Pat. Nos. 2,925,706, 3,780,526, 4,130,987 and 4,627,739.

OBJECTS AND BRIEF SUMMARY OF THE INVENTION

An object of the present invention is to provide another type of watch which may also be used as an ornamental bracelet.

According to the present invention, there is provided a watch, comprising: an annular member of a diameter to enclose a wearer's wrist including viewable graduation markings around its circumference graduated according to time; a pointer member on the circumference of the annular member and viewable with the graduation markings; one of the members being rotatable relative to the other member; and a drive for rotating the rotatable member to effect relative movement between the pointer member and the graduation markings at a predetermined uniform velocity such that the pointer indicates the time according to its location relative to the graduation markings on the circumference of the annular member.

According to further features in the preferred embodiments of the invention described below, the annular member includes a transparent cover around its circumference permitting viewing of the pointer member and graduation markings; also, the markings are equally spaced around the complete circumference of the annular member and indicate the twelve hours of a day.

Two preferred embodiments of the invention are described below for purposes of example. In both preferred embodiments, the watch is a wrist watch, and the annular member is in the form of a bracelet for loosely enclosing the wrist of a wearer; also, the drive rotates the pointer relative to the graduation markings.

According to still further features in one described preferred embodiment, the pointer member is mounted on a ring rotatable about an axis coaxial with the axis of the bracelet; and the drive comprises a motor carried by the bracelet and driving the ring via a wheel rotated by the motor and engaging the rotatable ring at the outer circumference of the wheel. The motor may be any type of motor commonly used in watches or clocks, such as a spring-driven motor or a battery-driven electrical motor.

A second embodiment of the invention is described wherein the drive is a stepping motor including a plurality of stator coils cooperable with a plurality of magnetic segments fixed to the rotatable member.

A watch may be constructed in accordance with the foregoing features in the form of an attractive bracelet to be loosely worn on the wrist of a user and also to serve as a watch. The watch permits the user to see the time by merely manually turning the bracelet around the wrist until the pointer can be seen with the adjacent graduation markings. The watch, however, may take forms other than a wrist watch, e.g., a finger-ring watch, or an annular pocket watch.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a side elevational view illustrating one form of wrist watch constructed in accordance with the present invention;

FIG. 2 is an end elevational view of the wrist watch of FIG. 1;

FIG. 3 is a sectional view along line III—III of FIG. 1;

FIG. 4 is an enlarged fragmentary view of a portion of FIG. 3;

and FIG. 5 is a partial view schematically illustrating a second embodiment of the invention including a stepping motor for effecting relative movement between the pointer and the graduation markings.

DESCRIPTION OF PREFERRED EMBODIMENTS

The wrist watch illustrated in FIGS. 1–4 of the drawings comprises a bracelet, generally designated 2, in the form of a circle of sufficiently large diameter so that it can be loosely worn on the wrist of a user like a conventional ornamental bracelet. The bracelet 2 is made of relatively rigid material, such as of plastic or metal, and may be suitably ornamented so as to provide an attractive appearance. The bracelet is enclosed by a cover 4 which is removablY retained in any suitable manner on the outer circumference of the bracelet.

As shown particularly in FIG. 2, the cover 4 is formed with graduation markings extending around the circumference of the bracelet to indicate the time of day. In the illustrated example, the graduation markings include numbers 6 to indicate the twelve hours of the day, equally spaced around the complete circumference of the bracelet. The space between each pair of adjacent numbers 6 is divided by lines 8 into four equally-spaced divisions, so that each division represents a fifteen minute interval. If desired, the graduation markings could include smaller divisions to represent "five minute" intervals, or even "one minute" intervals.

The cover 4 for the bracelet 2 is of transparent material, except for the graduation markings 6 and 8.

A ring 10 is rotatably mounted on the outer circumference of bracelet 2 under its cover 4. Rotatable ring 10, which may be made of suitable plastic or metal material, is of circular shape and is rotatable about axis 12 which is coaxial with the axis of the bracelet 2. Ring 10 is rotatably mounted in a recess 14 defined by a pair of annular ribs 16, 18 extending around the circumference of the bracelet. As shown in FIG. 3, annular rib 16 is integrally formed in the outer surface of the bracelet 2, whereas rib 18 is formed as a separate ring and is bonded to the outer face of the bracelet, to define the recess 14 for receiving the rotatable ring 10, after the rotatable ring has been applied.

A pointer 20 is mounted on rotatable ring 10 and is movable along the outer circumference of bracelet 2 under its cover 4, so as to be viewable through the cover.

Ring 10 is rotated at a predetermined uniform velocity by a drive, generally designated 22, carried by bracelet 2 under its cover 4. Drive 22 includes a motor which rotates a rubber wheel 24 whose outer surface frictionally engages ring 10 to rotate the ring, and thereby the pointer 20.

Motor 22 may be any type of motor commonly used in a clock or watch mechanism. For example, it could be a spring-driven motor. Preferably, however, it is a battery-driven electric motor, and for this purpose the underlying section of the bracelet 2 includes a removable lid, as shown schematically at 2' in FIG. 4, to permit replacement of the battery.

Drive 22 further includes a manually-rotatable knob 26 for presetting the position of the rotatable ring 10 and of its pointer 20 with respect to the graduation markings 6, 8. The presetting mechanism controlled by knob 26 may be of any conventional construction, e.g., effective to enable presetting the position of the pointer 20 by pulling the knob outwardly and then rotating it in one or the other direction to preset the pointer. If the drive 22 is in the form of a spring motor, knob 26 may also be used for loading the spring, as in a conventional spring-driven clock.

It will thus be seen that the bracelet, and its cover 4, may be constructed in the form of an attractively-appearing bracelet to be loosely worn on the wrist of a user. The clock drive 22 rotates the rubber wheel 24, the rotatable ring 10, and its pointer 20, at a uniform velocity such that the pointer 20 traverses the complete circumference of the bracelet in each twelve-hour period. Thus, whenever it is desired to see the time, it is only necessary to manually rotate the bracelet, if necessary, so as to enable viewing the pointer 20, and its location with respect to the graduation markings 6, 8, which will thereby indicate the time.

FIG. 5 schematically illustrates a second embodiment of the invention utilizing a stepping motor for effecting relative movement between the pointer (20, FIG. 3) and the graduation markings 6 (FIG. 2). In the embodiment of FIG. 5, the pointer is also rotated relative to the graduation markings.

Thus, in the embodiment of FIG. 5 the pointer (20, FIG. 3) is carried by a ring 50 which includes a plurality of magnetic segments 52 spaced around its circumference; and the motor includes a plurality of coils $L_1$-$L_3$ fixed to the bracelet (2, FIG. 1) in alignment with the magnetic segments 52. The bracelet further includes an electrical control unit 54 which supplies pulses to the coils $L_1$-$L_3$ in sequence so as to effect the rotation of the ring 50 in a step-by-step manner, as known in step motors of this type.

While the invention has been described with respect to two preferred embodiments, it will be appreciated that many variations may be made. For example, the pointer (20) may be fixed, and the annular member (e.g., cover 4) carrying the graduation markings 6, 8, may be rotated relative to the fixed pointer. Also, the markings may be in other time units, e.g., to indicate a complete 24-hour interval around the complete circumference of the annular member. Further, other forms of drive may be used for driving the pointer 20 around the circumference of the bracelet. In addition, instead of using a rubber wheel 24 coupling between the motor 22 and the rotatable ring 10, there may also be used a gear coupling or a rubber-band coupling. The rotatable member may be rotated on bearings, and need not be received within a recess. Also, the novel watch could be used in forms other than wrist bracelets, as indicated earlier.

Many other variations and applications of the invention will be apparent.

What is claimed is:

1. A watch, comprising:

an annular member of a diameter to enclose a wearer's wrist and including viewable graduation markings around the circumference graduated according to time;

a pointer member on the circumference of the annular member and viewable with said graduation markings;

one of said members being rotatable relative to the other member;

and a drive for rotating said rotatable member to effect relative movement between said pointer member and said graduation markings at a predetermined uniform velocity such that the pointer member indicates the time according to its location relative to the graduation markings on the circumference of the annular member.

2. The watch according to claim 1, wherein said annular member includes a cover around its circumference which is transparent to permit viewing of the pointer member and graduation markings.

3. The watch according to claim 1, wherein said markings are equally spaced around the complete circumference of the annular member and indicate the twelve hours of a day.

4. The watch according to claim 1, wherein said drive rotates said pointer member relative to said graduation markings.

5. The watch according to claim 1, wherein said watch is a wrist watch, and said annular member is in the form of a bracelet for loosely enclosing the wrist of the wearer.

6. The watch according to claim 5, wherein said pointer member is mounted on a ring rotatable about an axis coaxial with the axis of the bracelet; and said drive comprises a motor carried by said bracelet and driving said ring.

7. The wrist watch according to claim 6, wherein said ring is rotatably mounted in an annular recess extending around the circumference of the bracelet.

8. The wrist watch according to claim 6, wherein said motor drives said ring via a wheel rotated by said motor and engaging the ring at the outer circumference of the wheel.

9. The wrist watch according to claim 8, wherein said wheel is a rubber wheel whose outer circumference frictionally engages the rotatable ring.

10. The wrist watch according to claim 6, wherein said motor is a spring-driven motor.

11. The wrist watch according to claim 6, wherein said motor is a battery-driven electrical motor.

12. The watch according to claim 1, wherein said drive is a stepping motor including a plurality of stator coils cooperable with a plurality of magnetic segments fixed to said rotatable member.

13. A wrist watch, comprising: a bracelet of a sufficiently large diameter such that is can be loosely worn on the wrist of a wearer, said diameter defining a circumference, said bracelet including viewable graduation markings around the circumference graduated according to time;

a pointer on he circumference of the bracelet and viewable with said graduation markings;

and a drive for rotating said pointer to effect relative movement between it and said graduation markings at a predetermined uniform velocity such that the pointer indicates the time according to its location relative to the graduation markings on the circumference of the bracelet.

14. The watch according to claim 13, wherein said bracelet includes a cover around its circumference which is transparent to permit viewing of the pointer and graduation markings.

15. The watch according to claim 13, wherein said markings are equally spaced around the complete circumference of the bracelet and indicate the twelve hours of a day.

16. The watch according to claim 13, wherein said pointer is mounted on a ring rotatable about an axis coaxial with the axis of the bracelet; and said drive comprises a motor carried by said bracelet and driving said ring.

17. The wrist watch according to claim 16, wherein said ring is rotatably mounted in an annular recess extending around the circumference of the bracelet.

18. The wrist watch according to claim 16, wherein said motor drives said ring via a wheel rotated by said motor and engaging the ring at the outer circumference of the wheel.

19. The wrist watch according to claim 18, wherein said wheel is a rubber wheel whose outer circumference frictionally engages the rotatable ring.

20. The wrist watch according to claim 16, wherein said motor is a battery-driven electrical motor.

* * * * *